US006170354B1

(12) United States Patent
Lee

(10) Patent No.: US 6,170,354 B1
(45) Date of Patent: Jan. 9, 2001

(54) STEERING GEAR BOX FOR TOY VEHICLE

(75) Inventor: Keung Lee, New Territories (HK)

(73) Assignee: New Bright Industrial Co., Ltd., Kowloon (HK)

( * ) Notice: Under 35 U.S.C. 154(b), the term of this patent shall be extended for 0 days.

(21) Appl. No.: 09/357,808

(22) Filed: Jul. 20, 1999

(51) Int. Cl.[7] ..... A63H 17/36

(52) U.S. Cl. ..... 74/496; 280/89.11; 280/93.51; 446/460; 446/468

(58) Field of Search ..... 74/496; 280/268, 280/89.11, 89.12, 93.51; 446/460, 468, 454

(56) References Cited

U.S. PATENT DOCUMENTS

| | | | | |
|---|---|---|---|---|
| 3,796,292 | * | 3/1974 | Harrison | 192/223.4 |
| 3,848,885 | * | 11/1974 | Hefren | 280/89.11 |
| 4,181,318 | * | 1/1980 | Applegate | 280/89.11 |
| 4,580,802 | * | 4/1986 | Herman et al. | 280/268 X |
| 4,758,012 | * | 7/1988 | Ogura et al. | 180/409 |
| 4,898,562 | * | 2/1990 | Ishimoto | 446/460 |
| 5,709,583 | * | 1/1998 | Suto et al. | 446/460 X |
| 5,882,241 | * | 3/1999 | Mullaney et al. | 446/454 X |

FOREIGN PATENT DOCUMENTS

| | | | | |
|---|---|---|---|---|
| 2181066 | * | 4/1987 | (GB) | 446/460 |
| 2187108 | * | 9/1987 | (GB) | 446/460 |

* cited by examiner

*Primary Examiner*—Charles A Marmor
*Assistant Examiner*—Ha Ho
(74) *Attorney, Agent, or Firm*—Nixon & Vanderhye P.C.

(57) ABSTRACT

A steering mechanism and associated gearbox is disclosed for a toy car or other small motorized vehicle. The steering mechanism comprises a steering arm, collar, return spring and an alignment adjustor. These components are externally mounted on a gear box and motor that allow remote control of the steering mechanism, and the wheels controlled by the steering mechanism.

8 Claims, 5 Drawing Sheets

STEERING GEAR BOX FOR TOY VEHICLE

FIELD OF THE INVENTION

The field of the invention relates to the field of steering mechanisms for vehicles, and, in particular, to steering mechanisms and associated gear boxes for toy vehicles and other small motorized devices.

BACKGROUND AND SUMMARY OF THE INVENTION

There is a long-felt need for steering mechanisms that may be conveniently arranged in and integrated with toy vehicles and other small devices. A steering mechanism controls, for example, the direction of travel of the front wheels of a toy sports car. The steering mechanism may be remotely controlled so that the car can be remotely steered.

Applicant has developed a novel steering mechanism for turning the front (and/or rear) wheels of a toy vehicle. The steering mechanism may be remotely controlled using a motorized gear box that controls the steering position of the mechanism. The gear box includes a motor that may be activated remotely, such as via a wireless transmission link. The motor in the gear box turns gears in the gear box that turn a steering arm of the steering mechanism. The steering arm engages and turns a steering carriage to turn the wheels of the vehicle.

The steering mechanism may include a steering arm that is coupled to the front wheels via a steering carriage. The front wheels of the vehicle are connected to the steering carriage. The carriage align the front wheels such that they both are pointed in the same direction. The carriage causes the wheels to turn in unison as the carriage is pivoted by the steering arm. The steering arm is attached at one end to an output shaft of a gear box. The opposite end of the steering arm engages the steering carriage. As the gear box causes the steering arm to pivot about the end of the arm coupled to the gearbox output. As the gear box pivots the steering arm through a range of approximately 30° or 40° to the left and to the right from top-dead center, the steering arm pivots the carriage and causes the wheels to turn.

The steering mechanism has a center position. When in this center position, the carriage and wheels are aligned for straight ahead travel (or, alternatively, the wheels may be aligned for a wide left or right turn). A return spring in the steering mechanism biases the steering arm to its center position. The spring causes the steering arm to be in its center position when the motor in the gear box is not activated to turn the wheels. The motor overcomes the spring force to turn the steering arm, carriage and wheels, but the spring force returns the arm to center the wheels of the vehicle when the motor is de-energized. The steering mechanism may also include a steering trim device that enables a toy operate to adjust the center position of the steering mechanism.

The inventive steering mechanism has a simplified and easy-to-form structure. The steering arm includes an annular collar that is directly coupled to the output of the gear box.

In addition, the trim adjustment is a simple cylindrical arrangement having an axially-offset post that adjusts the center position of the steering arm return springs and hence the steering arm. The trim cylinder has a manual set tab that allows an operator to adjust the center position of the steering mechanism and hence the wheel alignment.

An advantage of the steering mechanism is that it is compact and fits nicely around a gear box. The steering mechanism and gear box can be easily fit into the undercarriage of a toy vehicle. Another advantage is that the steering mechanism is formed of three plastic parts and a simple coiled spring which reduces construction costs and simplifies assembly of the steering mechanism. The primarily plastic steering mechanism is safe, especially in view of conventional steering mechanisms that tend to be formed of several metal parts that can injure children. Another safety feature is that the plastic parts that constitute the steering mechanism are attached by a screw to the gear box such that the components of the mechanism are not easily detached from the toy. In addition, the steering mechanism and gear box can be completely contained within the undercarriage of the vehicle so that children cannot easily reach the steering mechanism. The alignment set tap is the only portion of the steering mechanism that is visible and reachable by children.

The gear box drives the steering mechanism. The gear box transmits rotation and torque through an assembly of intermeshing rotating gears. An input shaft to the gear box transmits a drive rotation to the gears and to an output shaft(s) from the box. As the drive rotation causes the intermeshing gears in the box to rotate, the rotational speed of each of the gears will vary depending on the gear teeth ratios of each pair of gears. The torque and rotational speed of the output shaft will be in proportion to the input shaft speed and torque, where the proportional relationship depends on the arrangement of gears between the input and output shafts.

The motorized gear box may include a housing that entirely encases the gears, so that dirt and dust cannot easily come between the gears. The gear boxes may also be integral with the housing of the toy to minimize the components in the toy and to reduce manufacturing costs. If an integral gear box is not practical, then an encasing gear box may be designed to fit easily in the housing of the toy adjacent to the wheels, mechanical arm or other component to be turned by the gear box. Accordingly, the gear boxes of the present invention seal the gears against dirt and dust, and may be integrated into the plastic housing of a toy or for a separate housing mounted within the toy.

The invention provides several advantages for steering mechanisms and gear boxes over the prior art including, but not limited to: improved safety, better resistance to dirt and grime, fewer components (especially metal components), lower manufacturing costs, and compact arrangements of motor and transmission gear assemblies. Safety is improved, especially for toys, because the invention reduces the number of small gears and other components needed for a steering transmission assembly and thereby reduces the number of components that may be separated from a toy and inadvertently swallowed by child. Safety is also improved by having spur gears formed of plastic, which is less likely to cut a child, than would metal spur gears. The invention resists dirt and grime by encapsulating gears and motors in gear boxes. The lower manufacturing costs flow from forming spur gears and steering mechanisms from plastic, rather than metal, and reducing the number of gears and other components previously used in gear boxes and steering mechanisms. In addition, compact arrangements of motors and transmission gear assemblies is achieved because the use of spur gears allows the motor to be arranged adjacent to the gear assembly.

BRIEF DESCRIPTION OF THE DRAWINGS

These, as well as other objects and advantages of this invention, will be more completely understood and appreciated by careful study of the following more detailed description of a presently preferred exemplary embodiment of the invention taken in conjunction with the accompanying drawings, of which.

DETAILED DESCRIPTION OF THE DRAWINGS

Figure 1:
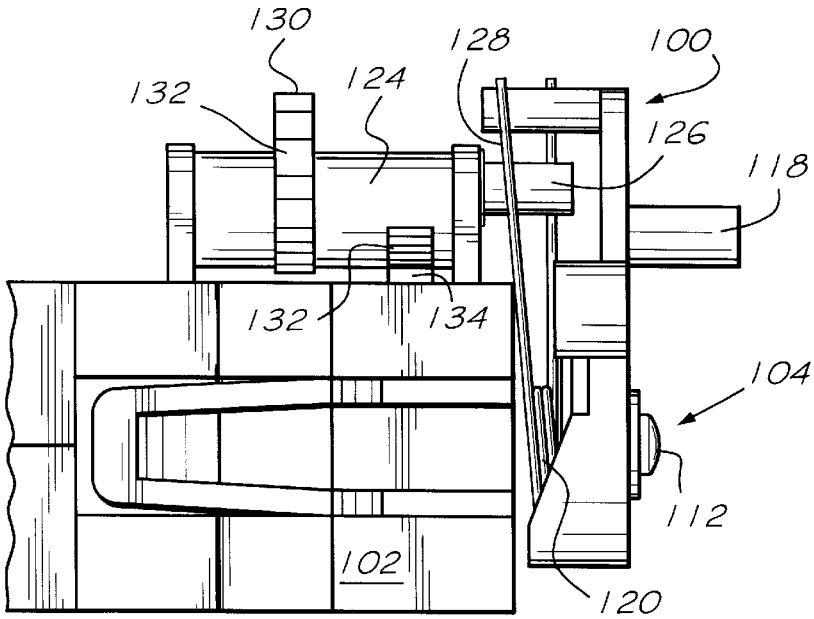
FIG. 1 is a side view of a partial section of a gear box with steering mechanisms.
Figure 2:
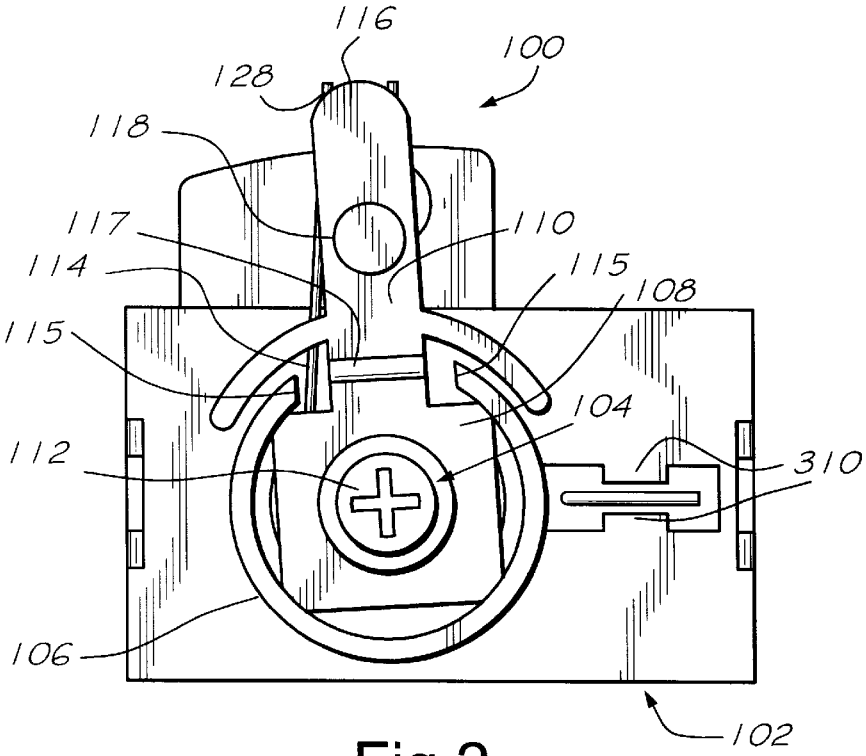
FIG. 2 is a front view of the gear box with steering mechanism shown in FIG. 1.
Figure 4:
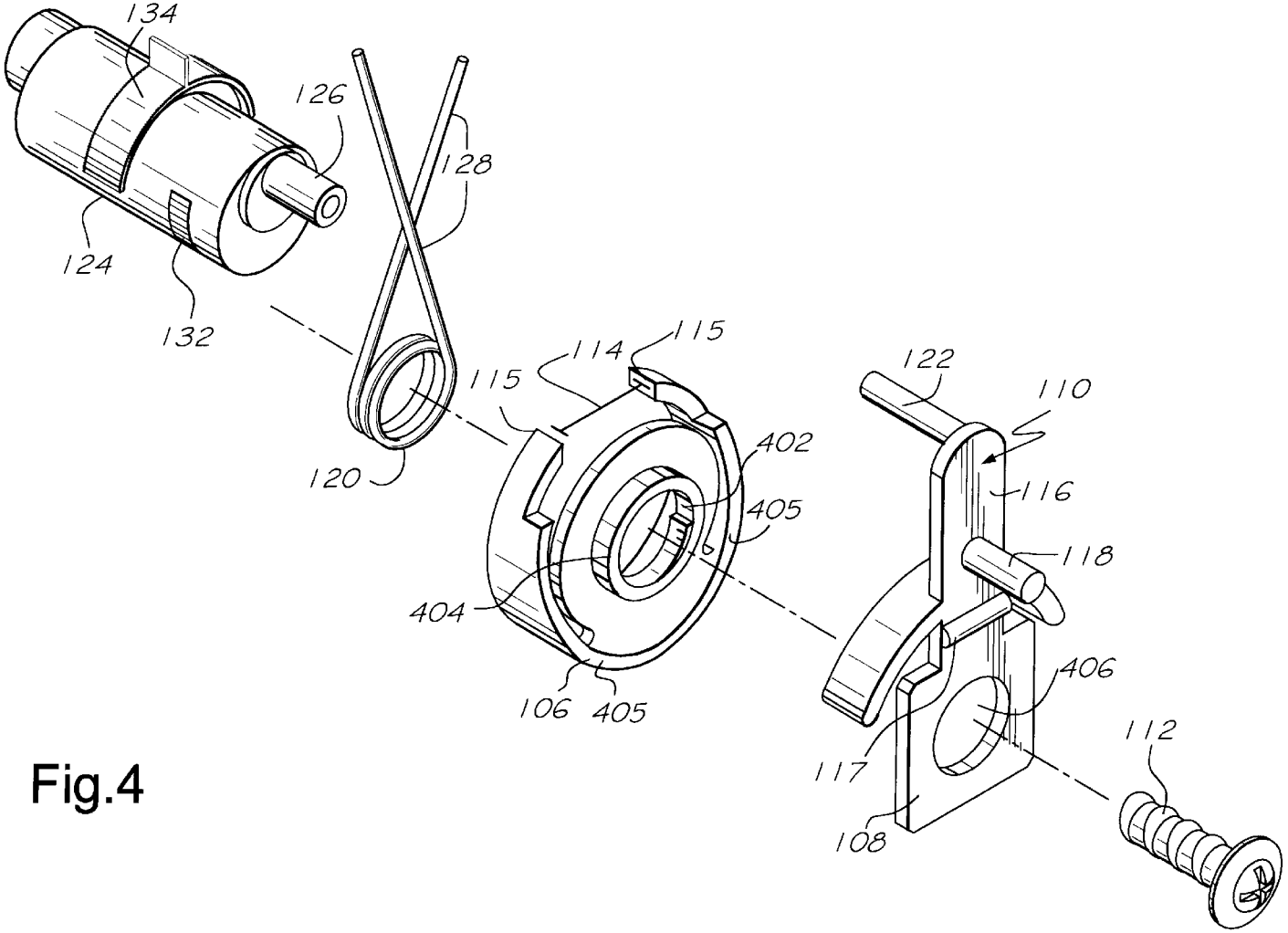
FIG. 4 is an exploded view of the steering mechanism shown in FIGS. 1 and 2.

FIGS. 1 and 2 show side and front views respectively of the steering mechanism 100 mounted on a gear box 102. In addition, FIG. 4 shows an exploded view of the steering mechanism. The gear box includes an internal motor and gearing that has an output shaft 104. Attached to the output shaft is a collar 106 and the base 108 of a steering arm 110. The collar is rigidly attached to the output shaft of the gear box, such as by a key on the shaft that engages a key slot 402 in a center aperture 404 of the collar.

The steering arm 110 is rotatably attached to the output shaft of the gear box via the collar. The steering arm fits loosely within the rim collar 405, and turns as the collar turns. Accordingly the output shaft 104 turns the collar 106, which in turn causes the steering arm 110 to turn. The collar and steering arm may be held in place on the output shaft by a screw and washer arrangement 112.

The collar 106 may be formed from injected molded plastic. The collar includes a raised rim 405 that encircles the base 108 of the turning arm. The collar rim is semicircular and has an open slot 114 through which passes the lever 116 of the turning arm. The annular collar turns the arm when the gear box motor is energized to turn the collar and circles the base of the arm, but has a wide slot to allow the arm to return with the wheel carriage to the center position by the steering trim device only, but without affecting the "stop" position of the collar in the center position. Thus, the gap between the collar and the steering arm allows the wheel carriage to return to the center position without requiring precise control of the steering arm.

The ends 115 of the collar rim engage the lever to turn the turning arm. As the collar turns, the ends 115 abut against the lever to turn the turning arm. The lever has a raised ridge 117 where the collar rim ends 115 abut the lever. The slot 114 in the collar is somewhat wider than the width of the lever 116 so that the lever and the collar may turn slightly with respect to one another.

The lever 116 of the turning arm includes a post 118 that connects with the steering carriage (not shown) of a toy vehicle. The movement of the post 118 through the arc caused by the turning of the steering arm will cause the steering carriage, and the front wheels of the vehicle to turn left or right. Accordingly, when the motor in the steering gear box is energized and the output shaft turns the collar 106 to the left or right, the turning arm will pivot with the collar and cause the post 118 to turn the steering carriage of the vehicle.

When the motor is not energized, the steering mechanism is spring 120 biased towards a center position. The center position will hold the steering carriage and the front wheels to a front line direction (or to a slight left or right turn depending on the trim adjustment set by the operator). For example, when the steering arm is turned fully to the right by the motor and then released by reversing the motor, the spring 120 keeps the steering arm to its center position, and, thus, returns the steering carriage to a center position. Since the collar has the slot 114 in-between the steering arm, the collar may slightly offset from the center position, while the vehicle continues to move along a straight path by the operation of the spring 120 and the steering arm 110 together.

The spring 120 may be a metal wire coiled around the output shaft of the gear box, and having arms extending to a bias post 122 at the end of the lever of the steering arm. Preferably, the bias post on the steering arm is at the far end of the steering arm to provide leverage on the steering arm by the spring force. The spring bias force is set to be sufficiently large to return the lever arm, gears and motor to a center position when the motor is not energized, and also maintains the lever arm to a center position when the vehicle is moving in a straight path. The spring bias force is overcome by the motor when energized to turn the steering arm to the left or to the right.

Figure 5:
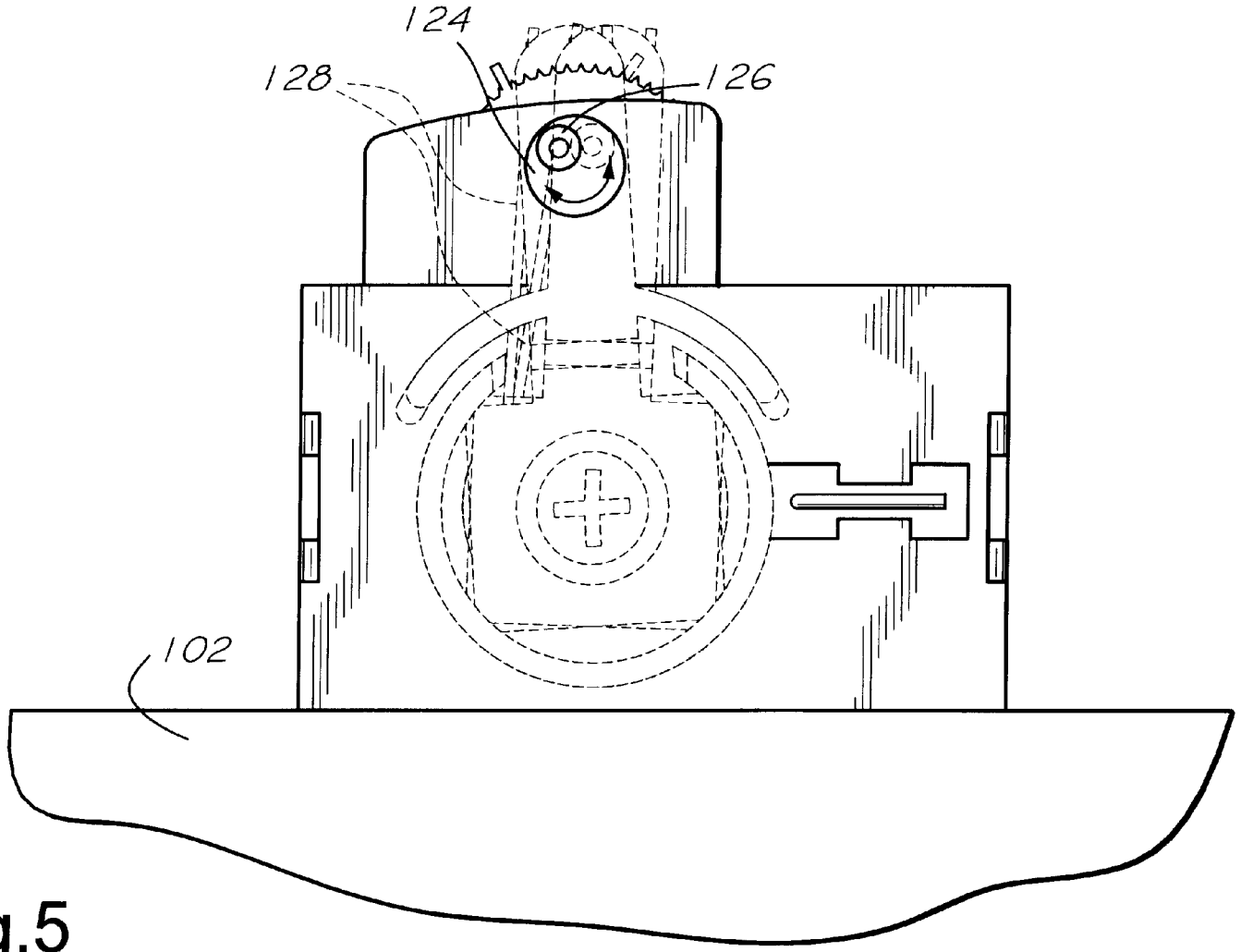
FIG. 5 shows a front view of the trim cylinder and a portion of the gear box shown in FIG. 1.

A wheel alignment or trim adjustment mechanism 124 allows the operator to set the center position of the steering mechanism. The steering trim may be a cylinder mounted to the outside of the gear box 102. An end of the trim cylinder may include a post 126 (see FIG. 4). The post is offset from the center line of the cylinder 124. By turning the cylinder to the left or right up to 45 degrees, the post 126 is moved slightly to the left or the right (see FIG. 5). The arms 128 of the spring 120 lean against either side of the post. The springs are moved slightly to the left or to the right as the post is turned with the rotation ol the cylinder. The movement of the post adjusts the center position of the arms 128 of the springs which, in turn, establishes the center position of the steering arm. By adjusting the center position of the steering arm with the trim mechanism 124, the center position of the front wheel of the vehicle can be adjusted slightly. For example, if the operator feels that the center position of the vehicle is slightly offset (this may arise from bumping the vehicle against obstacles or from the assembly process in production), the operator may modify the center position by adjusting the turning tab at the base of the vehicle to set the wheels straight.

The trim cylinder 124 includes a turning tab 130 that extends through the undercarriage of the vehicle and can be turned by an operator to set the center steering position of the vehicle. In addition, the steering cylinder includes knurled ribs 132 that engage ribs 134 on the gear box and on the undercarriage (not shown) of the vehicle. The engagement between the ribs on the gear box on the undercarriage and the knurled regions of the trim cylinder allows the trim cylinder to be held in the rotational position set by the operator. The operator must apply sufficient finger force to overcome the engagement between the ribs and the knurled surfaces and turn the cylinder. Moreover, engagement between the ribs and the knurled surfaces ensures that the spring 120 does not cause the trim adjustment post 126 to move unintentionally.

Figure 3:
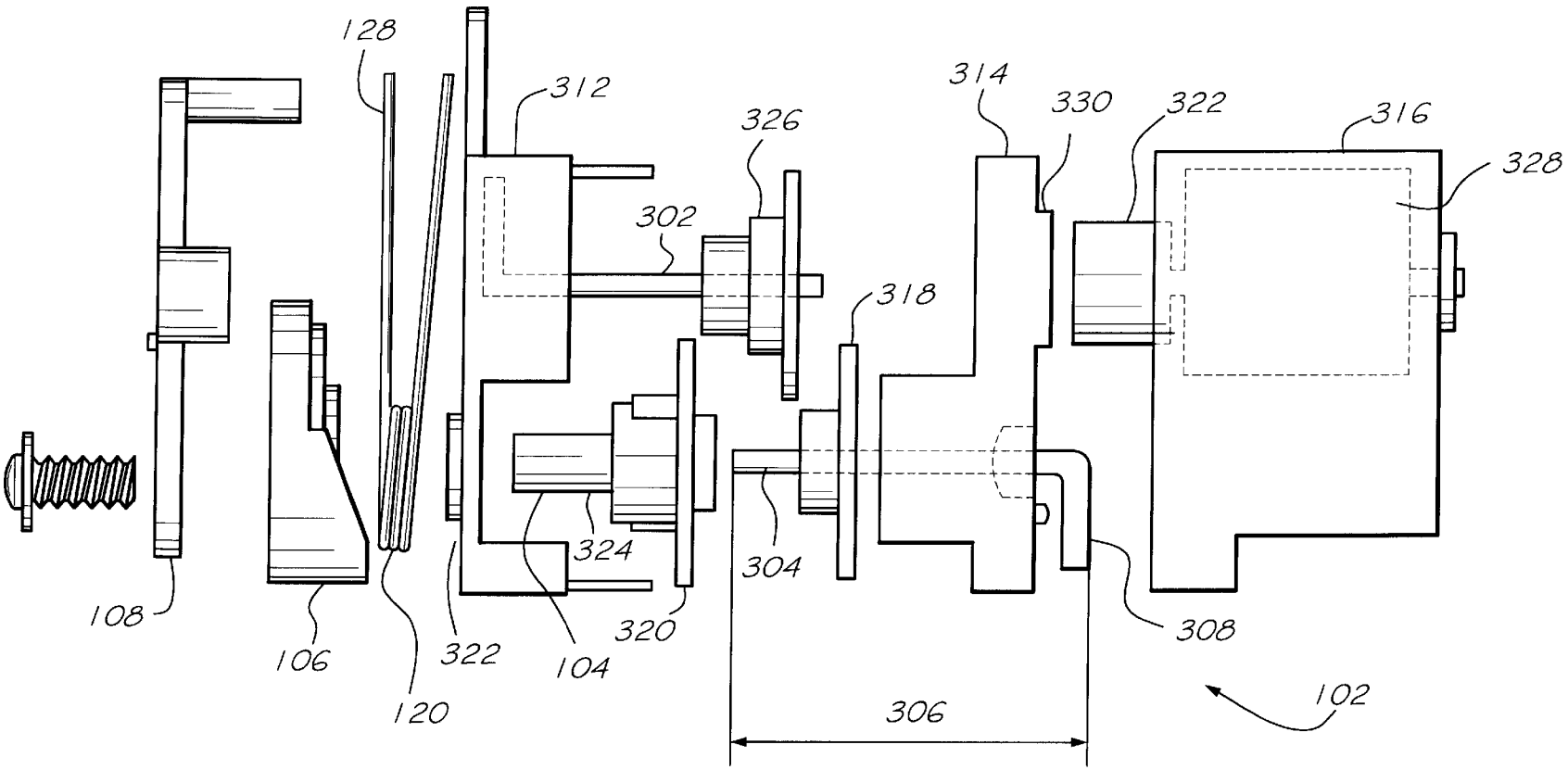
FIG. 3 is an exploded view of the steering gear box shown in FIG. 1 with motor and gearing.

FIG. 3 shows a steering gear box 102, in an exploded view. A feature of this gear box is that the gear shafts 302 and 304 are an L-shaped axle. The L-shaped axle has straight gear shaft section 306 that functions as a typical straight axle gear shaft. In addition, the axle has a bent portion 308 that may be perpendicular to the remainder portion of the axle.

The purpose of the bent portion is to provide an anchor to prevent rotation of the shaft or movement of the shaft within the gear box. The bent portion 308 may be held within the gear box by having it fit within a recess (not shown) in the gear box housing or fit between a pair of posts 310 on an outer surface of the gear box housing. The posts may be easily formed by plastic injection molding during the molding process of the housing. The posts 310 on either side of the bent portion 308 of the axle prevent the axle from rotating and may pinch the axle to hold it in place.

The gear housing 102 has a first housing 312 that attaches to a second gear box housing 314, and a motor housing 316 that is assembled together with the housings to form gear box 102. Each of these casings and housing may be formed by plastic injection molding.

The L-shaft 304 is supported by the second gear box housing 314. The axle section 306 of the L-shaft 304 extends inwardly into the gear box to form a gear shaft for a spur gear 318 and an output gear 320. The output gear has an output shaft 104 that extends through an output aperture 322 in the first gear box casing 312. The output shaft 104 may have a key 324 to engage slots within the output aperture 322 to restrict annular movement of the output gear, e.g., to a range of 60 degrees, and to fixedly engage the collar 106. In addition, an intermediary gear 326 links the spur gear 318 and output gear 320. A gear shaft 304 extending from the second gear casing 314 supports the intermediary spur gear 318 and the output gear 320. The second gear shaft 302 is also an L-axle, that engages posts (not shown) on the inside surface of the casing 314. A drive shaft from motor 328 extends through aperture 330 in the gear housing 314 to engage a spur gear or motor gear 332.

Figure 6:
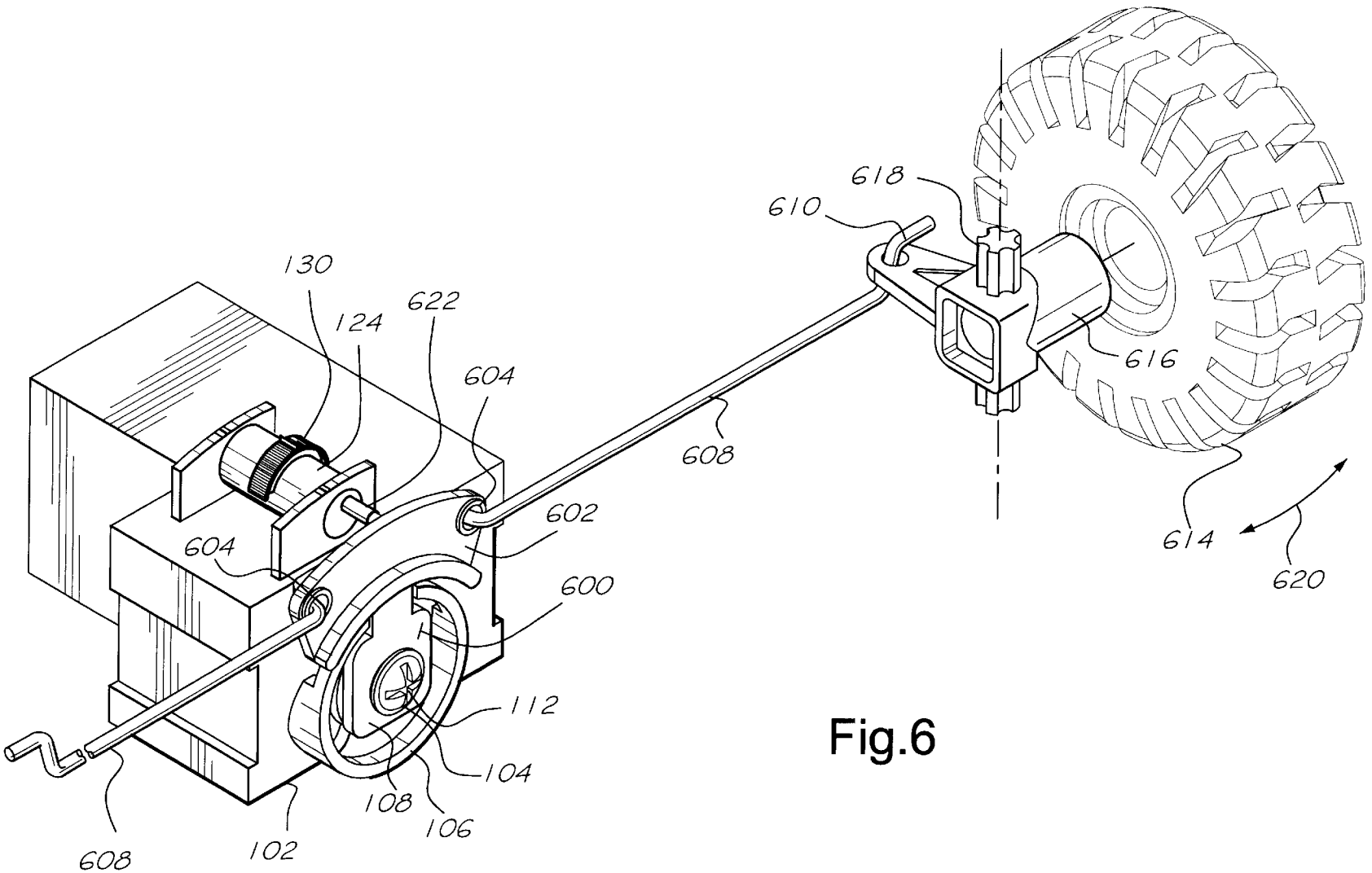
FIG. 6 shows an alternative embodiment of a steering arm that is coupled to a steering rod and steering wheel.

FIG. 6 shows an alternative steering arm 600 to the steering arm 110 shown in FIG. 2. The steering arm 600 has a base 108 that is secured to the output shaft 104 of a gear box 102, in a manner similar to that shown in FIG. 2. Similarly, the base 108 of the steering arm 600 is captured within a collar 106 in a similar manner as described in connection with FIG. 2.

The steering aim 600 has a wide lever arm 602 that includes apertures 604 to receive steering arm 608. The steering arm 600 with a widened lever arm 602 has a shape resembling a "T" with the base 108 being the leg of the T and the widened lever aim being the cap of the T. The aperture 604 in the lever arm 602 pivotably engages an end of the steering rod 608. Each steering rod 608 at an opposite end fits into a wheel support 612 for steering wheel 614. As the lever arm 602 moves each of the steering arms 608, the movement causes the wheel support 612 to pivot about pivot point 618 which may be secured to the chassis of the vehicle. The wheel 614 is rotatably mounted on bearing post 616 of the wheel support. By pivoting the wheel support 612, the wheel 614 is turned in either a left or right direction as shown by arrow 620. Accordingly, the movement of the steering arm 600 causes the steering wheel 614 to turn right or left (620).

The lever arm 602 is held in a center position by the spring 120 and trim control 124 (which are not shown in conjunction with FIG. 6), but are present in the embodiment of the steering arm shown in FIG. 6. In addition, a post 622 on the back side of the lever arm 602 engages the trim adjustment mechanism 124.

The invention has been described in connection with what is presently considered to be the preferred embodiment. The invention is not limited to the disclosed embodiment. The invention covers various modifications and equivalent arrangements included within the spirit and scope of the appended claims.

What is claimed is:

1. A steering mechanism comprising:

a steering arm having a first end rotatably coupled to a gear box output shaft and a second end connectable to a steering carriage;

a collar fixably connectable to the output shaft and pivotably connectable to the first end of the steering arm, and a spring coiled around the output shaft and having at least one arm extending to the second end of the steering arm to bias the steering arm to a center position.

2. A steering mechanism as in claim 1 further comprising:

an alignment post aligned with a null position of the steering arm, and the post receives at least one arm of the spring when the steering arm is in the null position.

3. A steering mechanism as in claim 2 wherein the alignment post is adjustable to move the null position of the steering arm.

4. A steering mechanism as in claim 3 wherein the alignment post is mounted on a rotatable cylinder having a finger turning lever.

5. A steering mechanism as in claim 1 where the second end of the steering arm extensions includes apertures to receive a steering rod or post to turn a steering carriage.

6. A steering mechanism and gear box comprising:

a steering arm having a first end rotatably coupled to a gear box output shaft, and a second end connectable to a turning mechanism for at least one wheel of a vehicle, a collar keyed to the output shaft of the gear box and which turns as the output shaft turns, and the collar having an aperture to receive the first end of the steering arm, wherein the aperture of the collar engages the first end to cause the steering arm to pivot as the collar turns, a spring coiled around the output shaft and having a spring arm extending to the second end of the steering arm to bias the steering arm to a null position, and the gear box having a motor coupled to the output shaft to turn the output shaft and steering arm.

7. A steering mechanism and gear box as in claim 6 wherein all shafts in the gear box are L-shafts.

8. A steering mechanism as in claim 6 wherein a gap between the collar and the steering arm allows the wheel carriage to return to the center position without requiring precise control of the steering arm.

* * * * *